US006752591B2

(12) United States Patent
Hain

(10) Patent No.: US 6,752,591 B2
(45) Date of Patent: Jun. 22, 2004

(54) SUSPENSION

(75) Inventor: Klemens Hain, Wiedenzhausen (DE)

(73) Assignee: MTU Aero Engines GmbH, Munich (DE)

( * ) Notice: Subject to any disclaimer, the term of this patent is extended or adjusted under 35 U.S.C. 154(b) by 115 days.

(21) Appl. No.: 10/182,798

(22) PCT Filed: Aug. 1, 2001

(86) PCT No.: PCT/DE01/02888

§ 371 (c)(1),
(2), (4) Date: Aug. 2, 2002

(87) PCT Pub. No.: WO02/12680

PCT Pub. Date: Feb. 14, 2002

(65) Prior Publication Data

US 2003/0021689 A1 Jan. 30, 2003

(30) Foreign Application Priority Data

Aug. 3, 2000 (DE) ..... 100 37 837

(51) Int. Cl.[7] ..... F01D 25/26
(52) U.S. Cl. ..... 415/136; 415/138
(58) Field of Search ..... 415/134, 136, 415/138, 139

(56) References Cited

U.S. PATENT DOCUMENTS 2,488,867 A * 11/1949 Judson ..... 415/136
2,996,279 A * 8/1961 Lorett et al. ..... 415/134
3,529,904 A * 9/1970 Borden et al. ..... 415/136
3,965,066 A * 6/1976 Sterman et al. ..... 415/138
4,441,313 A 4/1984 Joubert et al.
5,076,049 A 12/1991 Von Benken et al.
5,259,183 A 11/1993 Debeneix

FOREIGN PATENT DOCUMENTS

| | | |
|---|---|---|
| CH | 363661 | 9/1962 |
| DE | 1004201 | 3/1957 |
| DE | 0716219 A1 | 6/1996 |
| DE | 19807247 C2 | 4/2000 |

* cited by examiner

*Primary Examiner*—Edward K. Look
*Assistant Examiner*—Richard A. Edgar
(74) *Attorney, Agent, or Firm*—Crowell & Moring LLP

(57) ABSTRACT

A suspension of an annular secondary structure on a primary structure, in the form of a spoke-type centering device, has at least three sliding guides distributed uniformly over the structure circumference. Each sliding guide allows at least a linear relative movement of the structures transversely to their axial direction. The linear direction of movement of each sliding guide runs, in relation to the structure-related radial direction at the location of the sliding guide, at an angle having radial and tangential direction components.

20 Claims, 2 Drawing Sheets

SUSPENSION

BACKGROUND AND SUMMARY OF THE INVENTION

This invention relates to the suspension of an annular secondary structure on a primary structure, in particular of a stator structure acted upon by hot gas on a casing structure of a gas turbine, in the form of what may be referred to as a spoke-type centering device.

Spoke-type centering devices are used in order to suspend annular secondary structures centrically on mostly likewise annular or tubular primary structures. In this case, radial relative movements of the structures in relation to one another are to be possible essentially without constraining forces and deformations, while at the same time concentricity is maintained. The principle is appropriate, in particular, when widely differing thermal expansions of two concentric structures are to be compensated. If the secondary structure is relatively elastic, that is to say has low dimensional stability, it should be, as far as possible, stabilized and stiffened via the suspension.

German patent publication DE 198 07 247 C2 discloses a turbomachine with rotor and stator, which has at least one specially designed guide-vane ring. The latter is designed as a self-supporting component with a reinforcement on the inner shroud and with a segmented outer shroud. The guide-vane ring is positioned in the casing of the turbomachine via a spoke-type centering device having at least three "spokes". The sliding guides of the spoke-type centering device have bearing journals in bearing bushes, and the linear direction of movement in each sliding guide runs radially with respect to the guide-vane ring and casing.

It is likewise customary to implement the sliding guides by way of sliding blocks running in straight grooves, the direction of movement running, as is usual, radially with respect to the coupled structures. Experience shows that pronounced wear often occurs on the sliding elements of conventional spoke-type centering devices. Permanent deformations of the thin-walled secondary structures have sometimes been detected. Both types of damage indicate that higher forces than should occur under ideally rotationally symmetrical conditions obviously arise in the guides. The cause is probably non-rotationally symmetrical expansion states of the structures, which, in gas turbines, may be brought about, in particular, by non-homogeneous gas temperature distributions. Especially where structures of large diameter are concerned, with a multiplicity of sliding guides, that is to say of "spokes", the risk of the occurrence of high constraining forces increases. By virtue of geometry, the orientation of the direction of movement changes only slightly from guide to guide, so that, in the event of expansion of the secondary-structure region located between them, jamming may occur in both guides because of a fall below the angle of friction, with the result that free structure expansion becomes impossible. A further disadvantage of the conventional radial spoke-type centering devices is that these "soft" secondary structures are stiffened only when there is an odd number of sliding guides ("spokes").

In view of these disadvantages of known spoke-type centering devices, one object of this invention is to find a suspension for an annular secondary structure on a primary structure in the manner of a spoke-type centering device having at least three differently oriented sliding guides. The suspension prevents or largely reduces the constraining forces and deformations, and also wear, and makes it possible to stiffen flexible secondary structures, irrespective of whether there is an even or odd number of sliding guides.

According to the invention, the linear direction of movement of each sliding guide is inclined at an angle β to the radial direction of the structures, so that the relative movement acquires a radial component and a tangential component. Guide jamming, with all its disadvantages, is thereby avoided with a high degree of reliability. This applies to homogeneous and non-homogeneous dimensional changes of the secondary structure. In the case of homogeneous rotationally symmetrical expansion or contraction of the secondary structure, the latter also executes a small relative rotation in relation to the primary structure for kinematic reasons, which in most cases is acceptable. In the case of non-homogeneous locally differing expansion or contraction of the secondary structure, the latter is deformed elastically to some extent away from the annular configuration. However, the sliding-guide forces resulting from this are substantially lower than during the jamming of a conventional radial spoke-type centering device. The dimensional deviations are likewise kept within acceptable limits. One effect of the invention, namely to increase dimensional stability, may permit the secondary structure to be designed to be more elastic and lighter than in a conventional spoke-type centering device.

BRIEF DESCRIPTION OF THE DRAWINGS

The invention is explained in more detail below with reference to the figures.

DETAILED DESCRIPTION OF THE INVENTION

Figure 1:
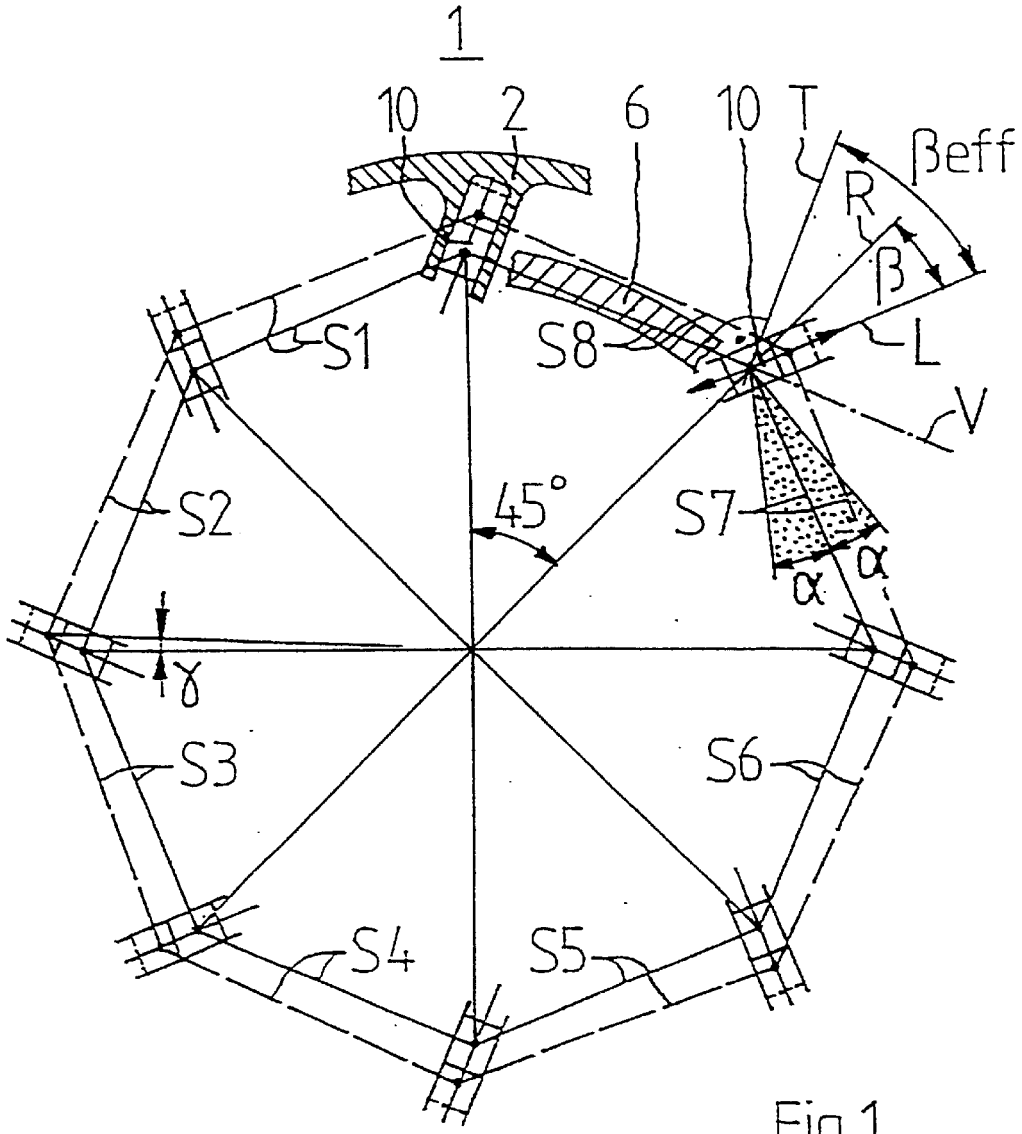
FIG. 1 shows a cross section through a suspension with eight sliding guides, reproducing two different rotationally symmetrical expansion states of a secondary structure.
Figure 2:
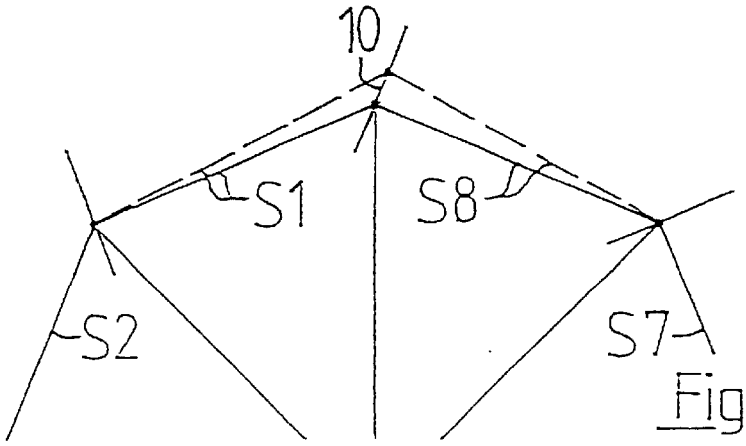
FIG. 2 shows a part cross section through the suspension according to FIG. 1 with an asymmetric expansion state of the secondary structure.

The illustrations according to FIGS. 1 and 2 are as far as possible in diagrammatic form, in order to reproduce the invention as simply and clearly as possible. The suspension 1, in the form of what may be referred to as a spoke-type centering device, comprises eight sliding guides 10 which are distributed uniformly on the circumference. The angular interval of the guides thus amounts to 45°. The structures, primary structure 2 and secondary structure 6, which are coupled by means of the suspension 1, are indicated in actual fact only as hatched fragments in the upper region of FIG. 1. Instead of the real annular secondary structure 6, a closed polygon with rigid chords S1 to S8 and with joints between the chords in the sliding guides 10 is considered here. The eight radial straight lines emanating from the structure center and in each case offset at 45° indicate only the structure-related radial direction R to the or in the chord joints and are not to be understood as structural elements. The sliding guide 10 on the angle bisecting line (45°) of the right upper quadrant shows that the linear direction of movement L of the sliding guide 10 deviates by an angle β from the radial direction R and therefore, de facto, has a radial and a tangential movement component. The selected angle β is preferably larger than the maximum angle of friction α to be expected in the sliding guide 10, so that, with a high degree of reliability, there need be no fear of jamming of the sliding-guide pairing. In the present conceptually simplified suspension 1 which has an articulated chord polygon and the sliding guides 10 of which are inclined clockwise at an angle β to the radial direction R, the change in length (expansion, contraction) of a chord leads to a sliding movement in the sliding guide at the chord end located clockwise at the front, since, on each chord, in each case only one sliding guide is inclined to the transverse direction of the chord by markedly more than the angle of friction, whereas the other sliding guide is approximately transverse to the chord.

To understand these kinematics more clearly, the sliding guide 10 at the top right in FIG. 1 is given additional particulars. In addition to the structure-related radial direction R at the location of the sliding guide, to the linear direction of movement L of the sliding guide 10 and to the angle β between R and L, there can also be seen, represented by dashes and dots, the straight prolongation V of the chord S8, the transverse direction T, at an angle of 90° to the chord S8, and the angle βeff between L and T. Furthermore, dots indicate what may be referred to as the friction cone of the sliding guide 10, the apex angle of which is twice as large as the angle of friction α. Since, here, the direction of movement L runs perpendicularly to the adjacent chord S7, the friction cone is mirror-symmetrical with respect to S7. Since the prolongation V lies well outside the friction cone, a change in length of S8 leads to a defined jam-free movement of the "joint" between S8 and S7 in the L-direction. It would therefore be sufficient, in theory, for the selected angle βeff to be larger than α. Since a real homogeneous secondary structure behaves differently from the simple articulated chord polygon, for safety reasons even the angle β should be larger than α.

For clearer understanding, terms, such as coefficient of friction and angle of friction, will be dealt with briefly at this juncture. The relation between the coefficient of friction f and the angle of friction α is as follows:

$$f = \tan \alpha$$

Hence, α is the inverse function of the tangent of f:

$$\alpha = \text{inv} \tan f$$

The following values for f may be gathered from technical encyclopaedias:

Solid-state friction f

Metal/metal 0.3÷1.5

Ceramic/ceramic 0.2÷1.5

Plastic/metal 0.2÷1.5

Boundary friction 0.1÷0.2

Mixed friction 0.01÷0.1

Fluid friction ≈0.01

At predetermined actual coefficients of friction, the following angles of friction are obtained:

| f | α |
|---|---|
| 0.2 | 11.3° |
| 0.3 | 16.7° |
| 0.5 | 26.6° |
| 1.0 | 45.0° |

As regards the suspension 1 illustrated, with 8 "spokes", the angle β, amounts to 22.5°. This inclination would probably be sufficient for a maximum coefficient of friction f<0.4. In the case of higher friction, the inclination β to the radial would have to be increased correspondingly.

FIG. 1 illustrates the chords S1 to S8, twice in each case to be precise, as unbroken and as broken straight lines. The unbroken chord polygon stands for a "cold" contracted state of the secondary structure 6. The broken larger chord polygon stands for a "hot" uniformly expanded state of the secondary structure 6. The primary structure 2 is in this case to remain unchanged geometrically for the sake of simplicity, so that that part of the sliding guides 10 which belongs to the primary structure does not move. In the event of an identical expansion or contraction of all the chords, the angles of articulation of the chord polygon obviously remain unchanged. This means, in terms of the real secondary structure 6, that its diameter changes, but not its shape (annulus). The concentric position in relation to the primary structure 2 also remains. It can also be seen that, at a transition from the unbroken position to the broken position, the chord polygon, and consequently the secondary structure, executes a small rotational movement clockwise through an angle γ, specifically as a result of the angle β of the sliding guides 10. In practical applications, this slight rotation due to the invention is, as a rule, of no importance for the functioning of the structure.

In contrast to FIG. 1, FIG. 2 shows an asymmetric expansion of the chord polygon. When turbomachines are used in practice, operating states with a highly asymmetric temperature distribution over the flow cross section may occur. Thus, according to FIG. 2, essentially only the chord S1 is to undergo thermal expansion. In this case, the sliding guide 10 at the "joint" between S1 and S8 executes a yielding movement obliquely upwards and to the right at the angle β. The chord S8 is in this case co-pivoted about its right-hand "joint" in relation to the chord S7, but in practice does not change its length. As a consequence of the kinematics predetermined by the sliding guides 10, a movement in the sliding guide 10 between S1 and S8 upwards and to the right, with the chord length of S8 remaining the same, results in only a negligible movement in the sliding guide between S8 and S7 downwards to the left, which practically cannot be illustrated in FIG. 2. Thus, de facto, the chord S8 executes only a pivoting movement about its "joint" in relation to S7, and the chord S7 remains in its position, as does the chord S2. It can be seen, however, that the "angles of articulation" between the chords S2/S1, S1/S8 and S8/S7 change. This means, in terms of the real secondary structure 6, that it is deformed asymmetrically and is no longer exactly circular. In this case, however, the actual changes in dimension and in shape are, as a rule, so small that their effects on functioning and on mechanical load can be ignored. The constraining forces and deformations occurring without the present invention would, as a rule, be more harmful.

Figure 3:
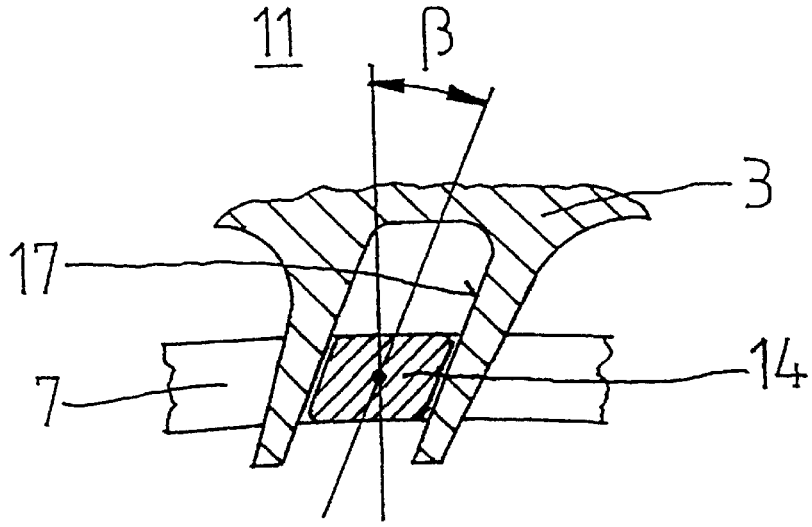
FIG. 3 shows a sliding guide with a rigid sliding block and slot.
Figure 4:
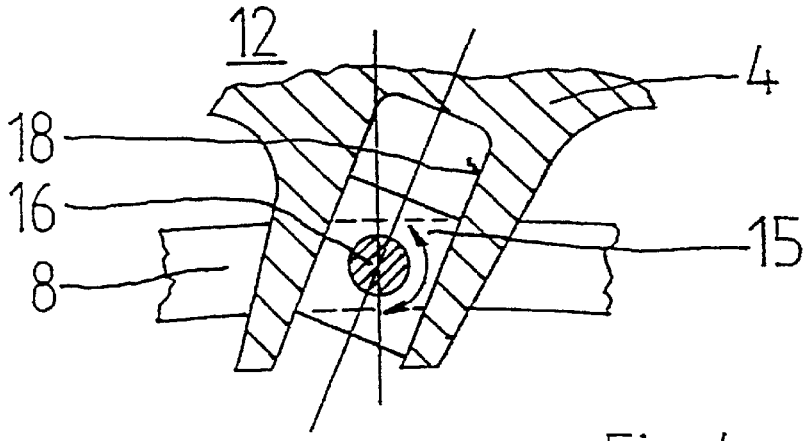
FIG. 4 shows a sliding guide with a pivotable sliding block and a slot.
Figure 5:
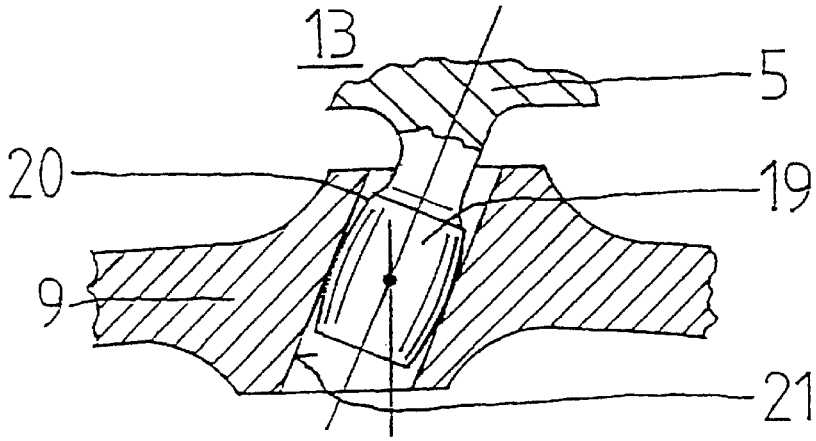
FIG. 5 shows a sliding guide with a pin and a bush.

FIGS. 3 to 5 show actual exemplary embodiments of sliding guides 11 to 13 with an inclination β according to the invention.

FIG. 3 shows a sliding guide 11 with a sliding block 14 in a slot 17. The slot 17 is integrated into the primary structure 3, and the sliding block 14 is connected firmly to the secondary structure 7 or is worked out from the latter. The sliding block 14 is deliberately illustrated with rounded corners and with sliding-surface clearance in the slot 17. During operation, for example in the event of asymmetric structure deformation, slight tilting movements to the sliding block 14 in the slot 17 may occur, clearance and corner rounding being intended to prevent excessive friction, wear and jamming.

FIG. 4 likewise shows a sliding guide 12 with a slot 18 integrated into the primary structure 4 and with a sliding block 15, although, in contrast to FIG. 3, the latter is pivotable about a shaft 16 which is connected firmly to the secondary structure 8. Small relative rotations of the structures 4, 8 are thereby easily possible. The fit of the sliding block 15 in the slot 18 can be made precise and largely free of play.

Finally, FIG. 5 shows a sliding guide 13 with a pin 19 in a bush 21. The pin 19, here, is connected firmly to the primary structure 5, and the circular-cylindrical bush 21 is integrated into a thickening of the secondary structure 9. The outer surface 20 of the pin 19 has a convex and rotationally symmetrical shape, in order to avoid edge stress or jamming during structure rotation. The convex shape may correspond, in an extreme case, to a spherical shape.

What is claimed is:

1. A suspension of an annular secondary structure on a primary structure, the suspension being of a stator structure acted upon by hot gas on a casing structure of a gas turbine, in the form of a spoke-type centring device comprising at least three sliding guides which are distributed over a structure circumference at equal angular intervals, each of the guides allowing at least a linear relative movement between the primary and the secondary structures transversely to their axial direction, a linear direction of movement changing from one sliding guide to the next by an angle which corresponds to an angular interval of the sliding guides, wherein the linear direction of movement of each sliding guide in relation to a structure-related radial direction at the location of the sliding guide runs at an angle having a radial direction component and a tangential direction component.

2. The suspension according to claim 1, wherein the angle is defined as a function of a maximum angle of friction to be expected in each sliding guide.

3. The suspension according to claim 2, wherein each sliding guide comprises a sliding block and a slot or a pin and a bush, wherein each sliding block or pin is connected to one of the structures, and wherein each slot or bush is connected to the other of the structures.

4. The suspension according to claim 3, wherein at least one of the sliding block and the slot, sliding on each other, has a wear-resistant metallic and/or ceramic sliding-surface coating.

5. The suspension according to claim 3, wherein at least one of the pin and the bush, sliding on each other, has a wear-resistant metallic and/or ceramic sliding-surface coating.

6. The suspension according to claim 3, wherein the sliding block of each sliding guide has convexly curved sliding surfaces, or wherein the pin of each sliding guide has a convex outer surface.

7. The suspension according to claim 6, wherein at least one of the sliding block and the slot, sliding on each other, has a wear-resistant metallic and/or ceramic sliding-surface coating.

8. The suspension according to claim 6, wherein at least one of the pin and the bush, sliding on each other, has a wear-resistant metallic and/or ceramic sliding-surface coating.

9. The suspension according to claim 3, wherein the sliding block of each sliding guide is arranged pivotably about a shaft oriented in the axial direction of the primary and secondary structures.

10. The suspension according to claim 9, wherein at least one of the sliding block and the slot, sliding on each other, has a wear-resistant metallic and/or ceramic sliding-surface coating.

11. The suspension according to claim 9, wherein at least one of the pin and the bush, sliding on each other, has a wear-resistant metallic and/or ceramic sliding-surface coating.

12. The suspension according to claim 1, wherein each sliding guide comprises a sliding block and a slot or a pin and a bush, wherein each sliding block or pin is connected to one of the structures, and wherein each slot or bush is connected to the other of the structures.

13. The suspension according to claim 3, wherein at least one of the sliding block and the slot, sliding on each other, has a wear-resistant metallic and/or ceramic sliding-surface coating.

14. The suspension according to claim 12, wherein at least one of the pin and the bush, sliding on each other, has a wear-resistant metallic and/or ceramic sliding-surface coating.

15. The suspension according to claim 12, wherein the sliding block of each sliding guide has convexly curved sliding surfaces, or wherein the pin of each sliding guide has a convex outer surface.

16. The suspension according to claim 15, wherein at least one of the sliding block and the slot, sliding on each other, has a wear-resistant metallic and/or ceramic sliding-surface coating.

17. The suspension according to claim 15, wherein at least one of the pin and the bush, sliding on each other, has a wear-resistant metallic and/or ceramic sliding-surface coating.

18. The suspension according to claim 12, wherein the sliding block of each sliding guide is arranged pivotably about a shaft oriented in the axial direction of the primary and secondary structures.

19. The suspension according to claim 18, wherein at least one of the sliding block and the slot, sliding on each other, has a wear-resistant metallic and/or ceramic sliding-surface coating.

20. The suspension according to claim 18, wherein at least one of the pin and the bush, sliding on each other, has a wear-resistant metallic and/or ceramic sliding-surface coating.

* * * * *